US009149171B2

(12) United States Patent
Chien

(10) Patent No.: US 9,149,171 B2
(45) Date of Patent: Oct. 6, 2015

(54) LEVER-TYPE MOP AND BUCKET FOR THE SAME

(71) Applicants: Hsieh-Fa Chien, Taipei (TW); Hsien-Chung Lin, Taipei (TW)

(72) Inventor: Hsieh- Fa Chien, Taipei (TW)

(73) Assignees: Hsieh-Fa Chien, Taipei (TW); Hsien-Chung Lin, Taipei (TW)

( * ) Notice: Subject to any disclaimer, the term of this patent is extended or adjusted under 35 U.S.C. 154(b) by 18 days.

(21) Appl. No.: 14/046,363

(22) Filed: Oct. 4, 2013

(65) Prior Publication Data

US 2014/0345075 A1 Nov. 27, 2014

(30) Foreign Application Priority Data

May 21, 2013 (TW) ..... 102117854 A

(51) Int. Cl.
*A47L 13/58* (2006.01)
*A47L 13/20* (2006.01)
*A47L 13/50* (2006.01)

(52) U.S. Cl.
CPC ..... *A47L 13/20* (2013.01); *A47L 13/50* (2013.01); *A47L 13/58* (2013.01)

(58) Field of Classification Search
CPC ..... A47L 13/50; A47L 13/58–13/60
USPC ..... 15/104.92, 142, 260–264
See application file for complete search history.

(56) References Cited

U.S. PATENT DOCUMENTS

| | | | | | |
|---|---|---|---|---|---|
| 603,547 | A | * | 5/1898 | Wolff | 15/260 |
| 2,163,638 | A | * | 6/1939 | Vaughn | 15/244.1 |
| 2,255,091 | A | * | 9/1941 | Vaughn | 15/260 |
| 2,443,954 | A | * | 6/1948 | Givens | 15/260 |
| 2,731,658 | A | * | 1/1956 | Miller | 15/244.1 |
| 2,851,710 | A | * | 9/1958 | Leach | 15/1 |
| 3,341,876 | A | * | 9/1967 | Campbell | 15/1 |
| 3,506,997 | A | * | 4/1970 | Coraminas | 15/262 |
| 3,562,841 | A | * | 2/1971 | Royalty | 15/260 |
| 5,941,410 | A | * | 8/1999 | Mangano | 220/735 |
| 5,956,795 | A | * | 9/1999 | Hirse | 15/119.1 |

FOREIGN PATENT DOCUMENTS

| | | | |
|---|---|---|---|
| DE | 10019211 | * | 9/2001 |
| WO | 98/06316 | * | 2/1998 |

* cited by examiner

*Primary Examiner* — Mark Spisich
(74) *Attorney, Agent, or Firm* — The Weintraub Group, P.L.C.

(57) ABSTRACT

A lever-type mop has a base, a cleaning unit, a connecting seat and a rod. The cleaning unit is attached on the bottom of the base. The rod is connected pivotally to the base through the connecting seat. The base has notches and the rod has a corresponding limiting protrusion. A bucket operated in coordination with the lever-type mop has an inclined surface and a straining board mounted under the inclined surface. When straining the cleaning unit, the base and the cleaning unit are put on the straining board and the rod is pivoted downward. With the abutting forces from the limiting protrusion and the inclined surface on opposite sides, the cleaning unit is squeezed. Therefore, the mop and the bucket have simple structures to achieve the purpose of squeezing the cleaning unit without touching the cleaning unit directly by the user's hand.

9 Claims, 10 Drawing Sheets

LEVER-TYPE MOP AND BUCKET FOR THE SAME

CROSS-REFERENCE TO RELATED APPLICATIONS

This application is based upon and claims priority under 35 U.S.C. 119 from Taiwan Patent Application No. 102117854 filed on May 21, 2013, which is hereby specifically incorporated herein by this reference thereto.

BACKGROUND OF THE INVENTION

1. Field of the Invention

The present invention relates to a lever-type mop and a bucket for the same, especially to a lever-type mop for cleaning and to a bucket that is cooperated with the lever-type mop.

2. Description of the Prior Arts

Mops are widely used for cleaning. Generally, the mops are used with buckets. Water is contained in the bucket such that the user can wash the mop nearby in the bucket to remove surplus water within the mop, so the mop can be used for cleaning again. In the past, the user had to manually squeeze the mop to get rid of the surplus water. However, squeezing the mop directly by hands easily harms the user's health because the mop and the surplus water are usually dirty.

Thus, some conventional mops and conventional buckets are invented to get rid of the surplus water by rotating the mop at high speed. However, those conventional mops and the conventional buckets have complicated gears or screw rods to implement the high speed rotation such that the conventional mops and the conventional buckets are not only expensive but also easily damaged because of the high speed rotation.

To overcome the shortcomings, the present invention provides a lever-type mop and a bucket for the same to mitigate or obviate the aforementioned problems.

SUMMARY OF THE INVENTION

The main objective of the present invention is to provide a lever-type mop and its bucket with simple structures. The lever-type mop has a base, a cleaning unit, a connecting seat and a rod. The cleaning unit is attached on the bottom surface of the base. The rod is connected pivotally to the base through the connecting seat. The base has notches and the rod has a corresponding limiting protrusion. The bucket has an inclined surface and a straining board mounted under the inclined surface. When straining the cleaning unit, the base and the cleaning unit are put on the straining board and the rod is pivoted downward. With the abutting forces from the limiting protrusion and the inclined surface on opposite sides, the cleaning unit is squeezed. Therefore, the mop and the bucket have simple structures to achieve the purpose of squeezing the cleaning unit without touching the cleaning unit by the user's hand.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
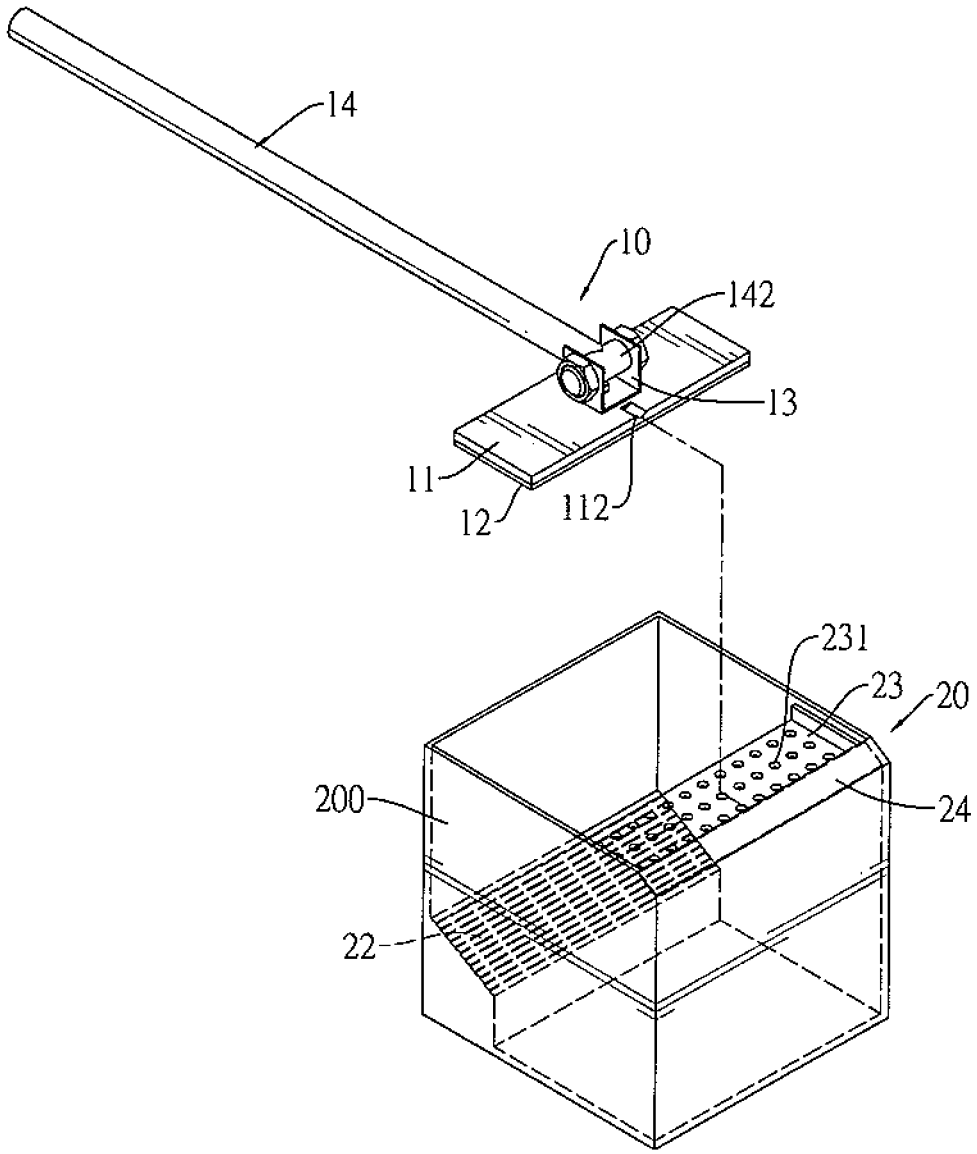
FIG. 1 is an exploded perspective view of a mop and a bucket in accordance with the present invention.
Figure 2:
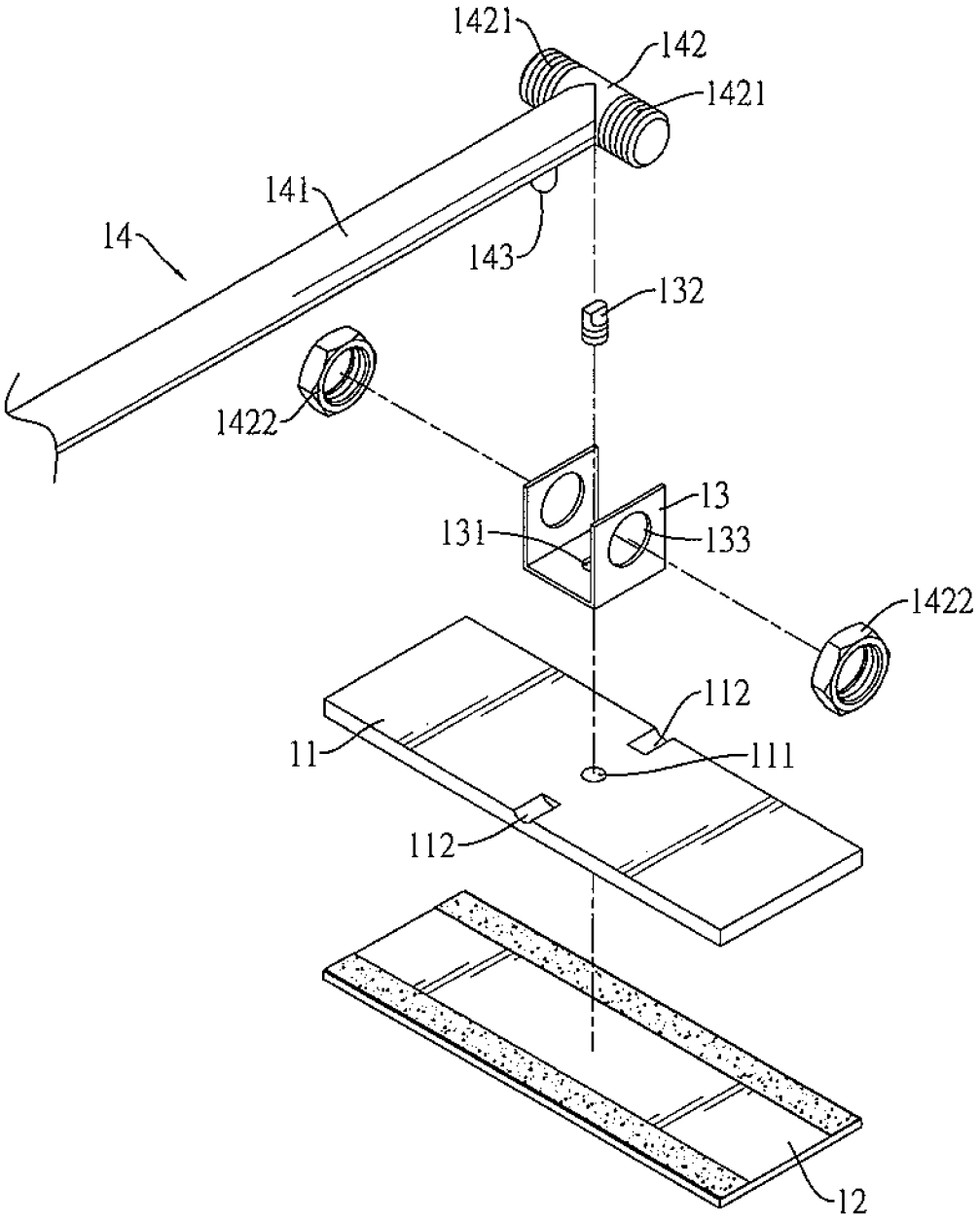
FIG. 2 is another exploded perspective view of the mop and the bucket in FIG. 1.

With reference to FIGS. 1 and 2, a lever-type mop 10 and a bucket 20 in accordance with the present invention are operated in coordination.

With reference to FIG. 2, the lever-type mop 10 comprises a base 11, a cleaning unit 12, a connecting seat 13 and a rod 14.

The base 11 has a pivoting recess 111 and two notches 112. The pivoting recess 111 is formed on a top surface of the base 11. The notches 112 are formed separately on the top surface of the base 11 and are respectively formed adjacent to opposite side edges of the base 11. In a preferred embodiment, the pivoting recess 111 and the notches 112 are aligned with each other.

The cleaning unit 12 is attached securely on a bottom surface of the base 11 and is made by materials that can absorb water for cleaning, such as, but not limited to, cotton strips, sponges, absorbent fibers and so on.

The connecting seat 13 is mounted pivotally on the top surface of the base 11 and has a pivoting hole 131, a pivoting stem 132 and at least one connecting hole 133. The pivoting hole 131 is formed through the connecting seat 13. The pivoting stem 132 is mounted pivotally through the pivoting hole 131 of the connecting seat 13 and is mounted pivotally in the pivoting recess 111 of the base 11 to connect the connecting seat 13 and the base 11 pivotally. The at least one connecting hole 133 is formed through the connecting seat 13. In a preferred embodiment, the connecting seat 13 is U-shaped and has a bottom wall and two sidewalls. Preferably, the connecting seat 13 has two connecting holes 133. The pivoting hole 131 is formed through the bottom wall. The connecting holes 133 are formed respectively through the sidewalls and align with each other.

The rod 14 is connected pivotally to the connecting seat 13 and has a rod body 141, a pivoting shaft 142 and a limiting protrusion 143. The pivoting shaft 142 is formed transversely on an end of the rod body 141 and is connected pivotally to the connecting seat 13. The limiting protrusion 143 protrudes on the rod body 141 and selectively engages the notches 112 of the base 11.

Figure 3:
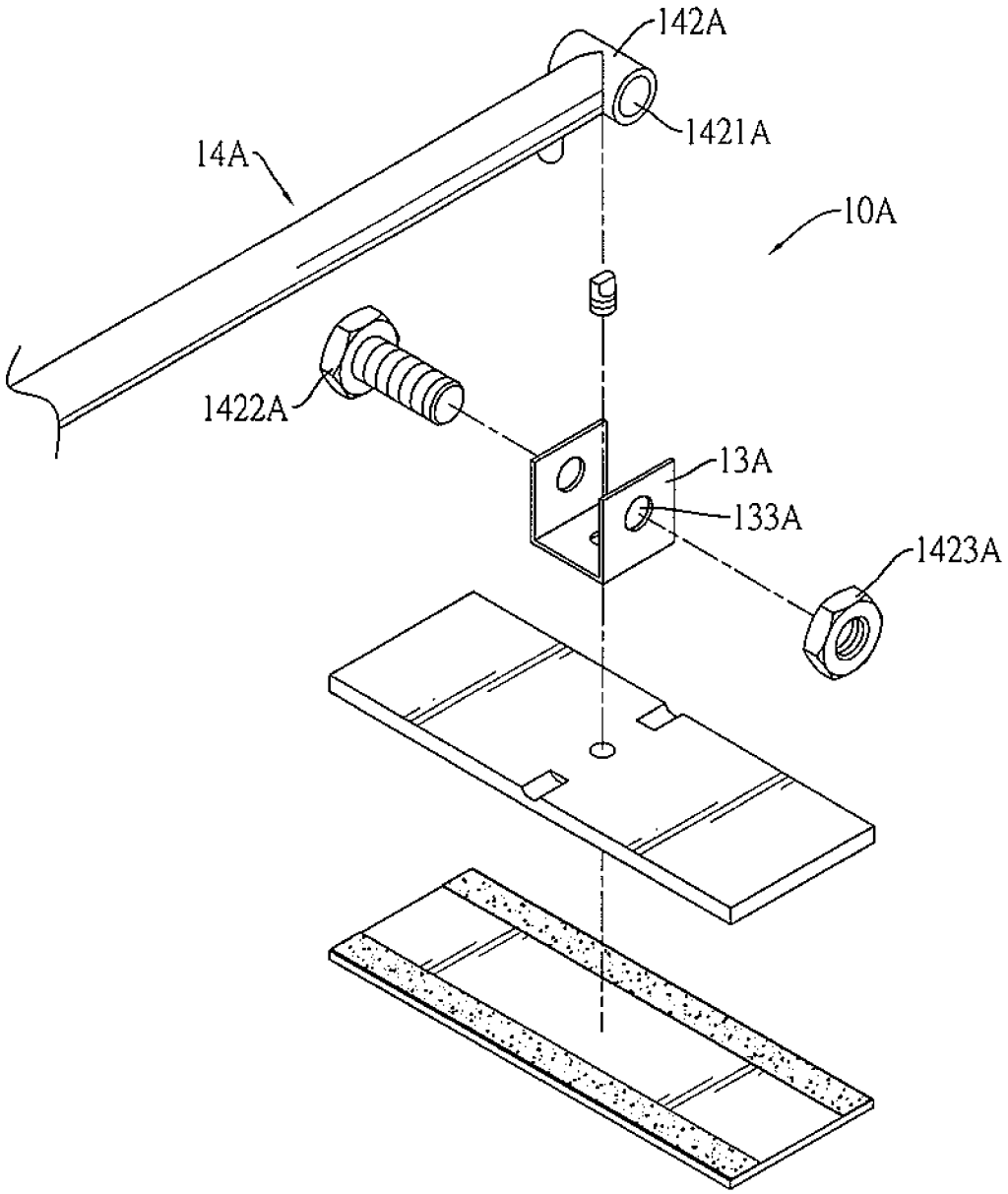
FIG. 3 is an enlarged exploded perspective view of the mop in FIG. 1.

The pivoting shaft 142 and the connecting seat 13 can be connected pivotally to each other by various structures. In one preferred embodiment shown in FIG. 2, the pivoting shaft 142 has two threaded parts 1421 respectively formed on two ends of the pivoting shaft 142. The threaded parts 1421 are mounted respectively through the connecting holes 133 of the connecting seat 13. Two nuts 1422 are respectively screwed onto the threaded parts 1421 to hold the pivoting shaft 142 in position. In another preferred embodiment shown in FIG. 3, the pivoting shaft 142A of the rod 14A has a shaft hole 1421A formed therethrough. A bolt 1422A is mounted through the connecting holes 133A and the shaft hole 1421A. A nut 1423A is screwed onto the bolt 1422A to hold the pivoting shaft 142A in position.

With the connecting seat 13 connecting pivotally with the base 11 and with the rod 14, the rod 14 can axially and radially pivot relative to the cleaning unit 12 so that the cleaning unit 12 can clean up different places such as corners, chinks, bottoms of the furniture and so on.

Figure 4:
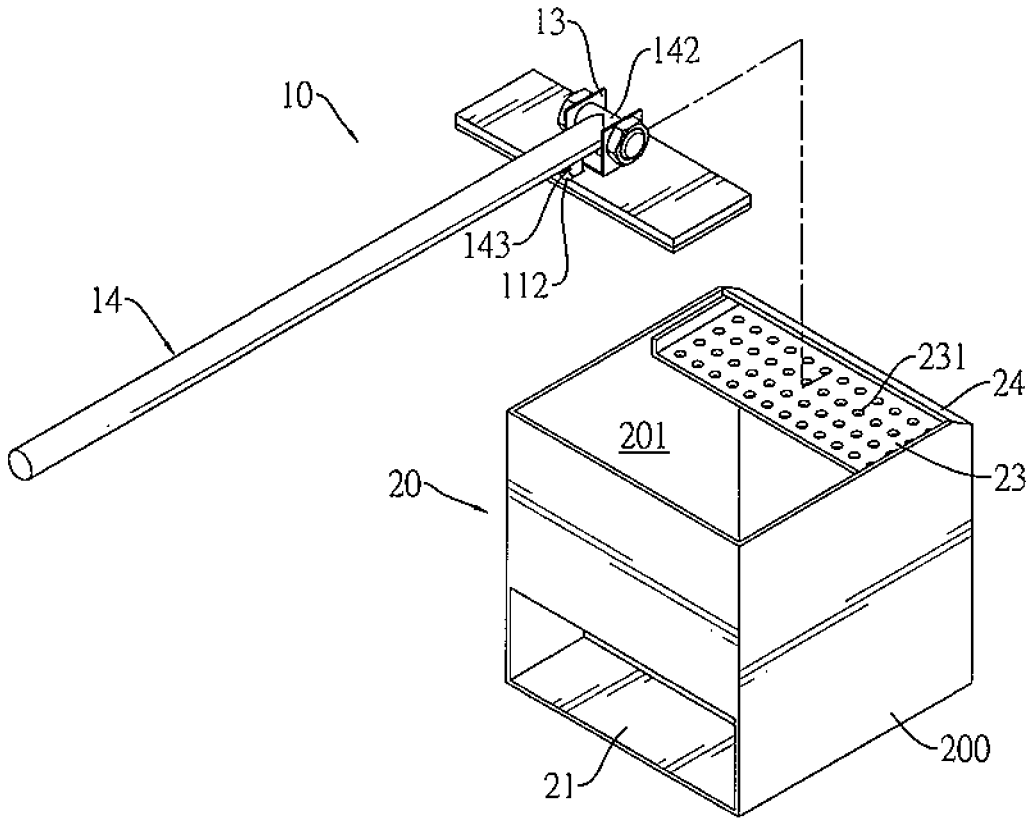
FIG. 4 is an enlarged exploded perspective view of another embodiment of a mop in accordance with the present invention.
Figure 5:
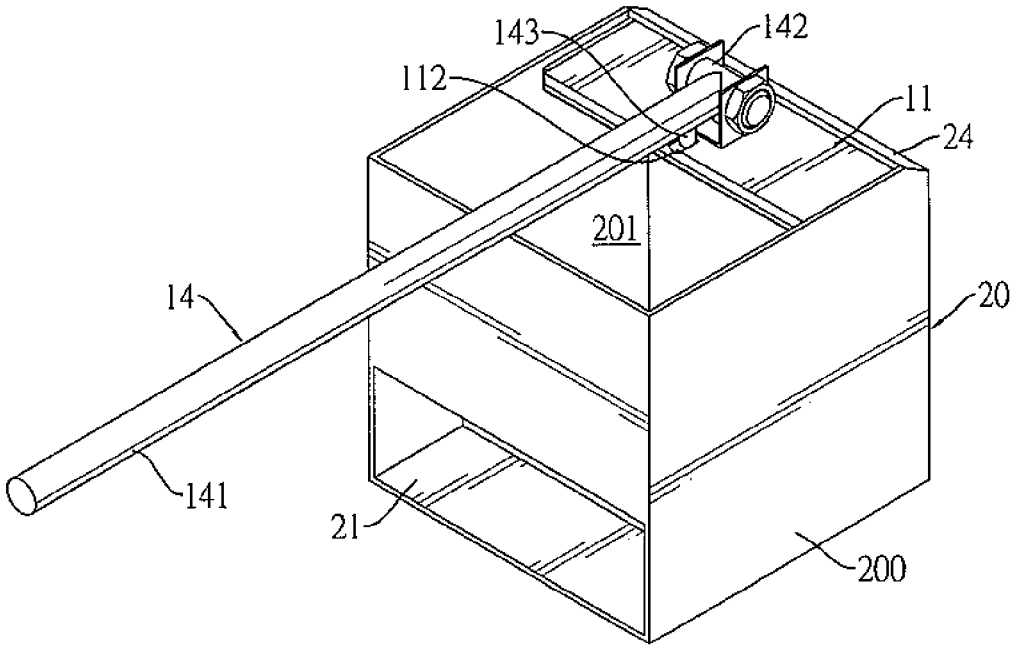
FIG. 5 is an operational perspective view of the mop and the bucket in FIG. 1.
Figure 6:
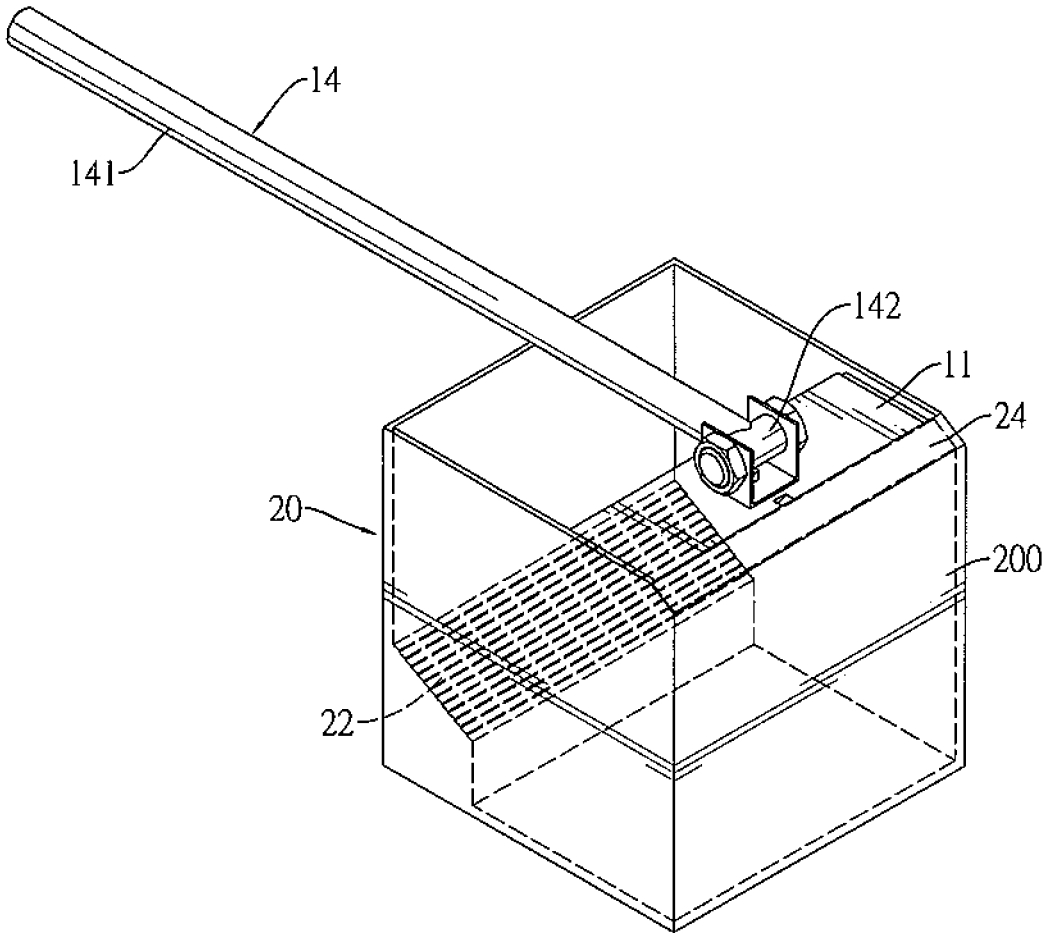
FIG. 6 is another operational perspective view of the mop and the bucket in FIG. 1.
Figure 7:
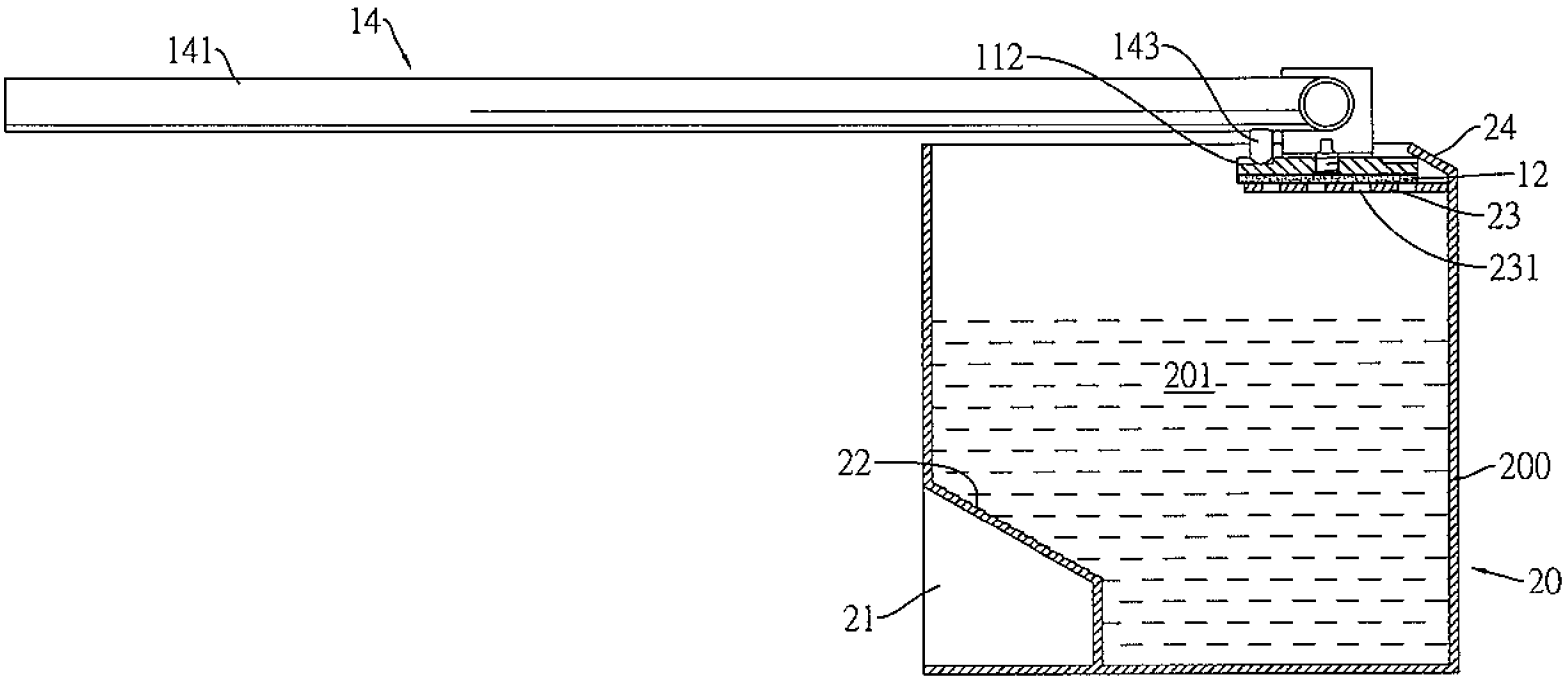
FIG. 7 is an operational side view in partial section of the mop and the bucket in FIG. 1.
Figure 8:
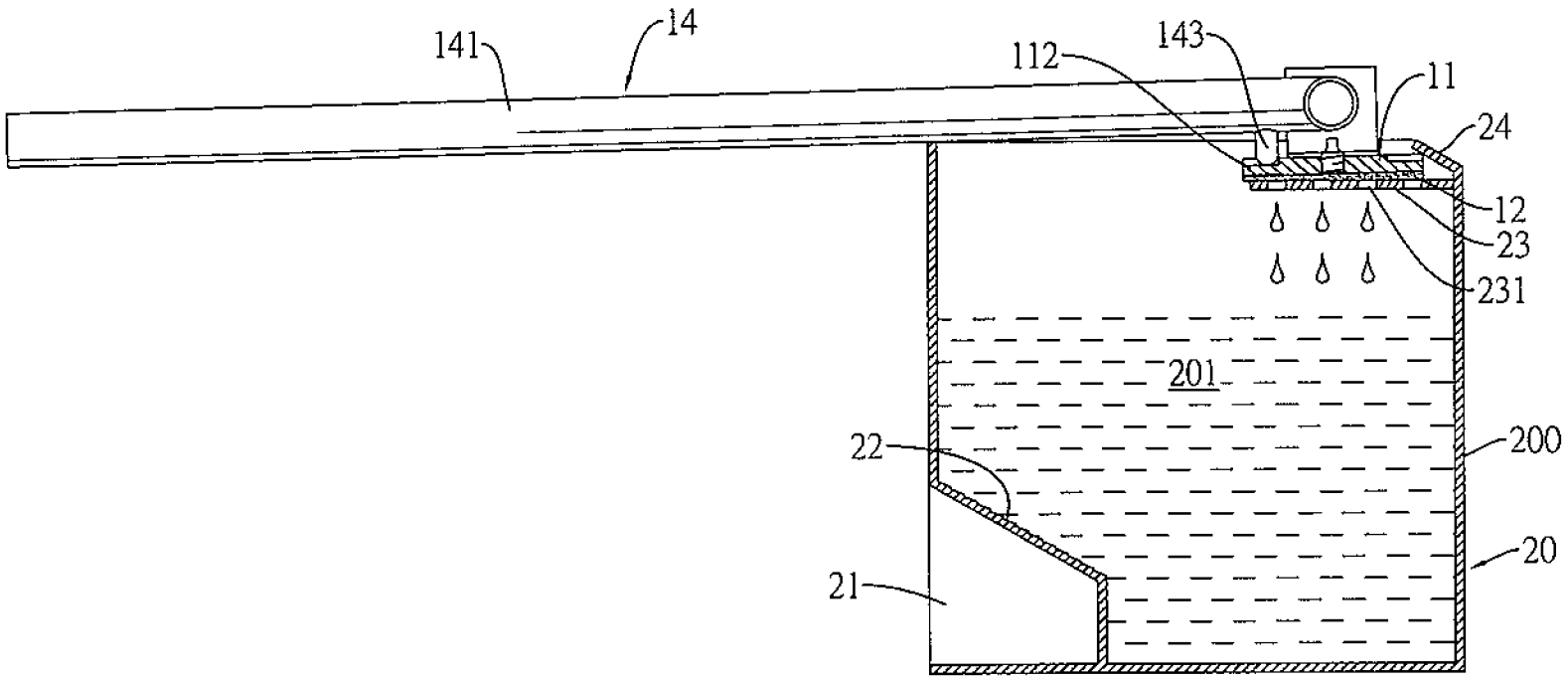
FIG. 8 is another operational side view in partial section of the mop and the bucket in FIG. 1, showing the mop being pressed downward.

With reference to FIGS. 1 and 4, the bucket 20 comprises a bucket body 200 and a straining board 23. The bucket body 200 has a cavity 201, a recess 21, a step 22 and an inclined surface 24. The cavity 201 is formed in the bucket body 200. The recess 21 is formed on an outside wall of the bucket body 200 near a bottom of the bucket body 200. The step 22 is formed in the cavity 201 and corresponds to the recess 21 and has multiple elongated protrusions formed thereon for user to scrub the cleaning unit 12 of the mop 10. The inclined surface 24 is formed on a top edge of the bucket body 200. The straining board 23 is mounted on the top edge of the bucket body 200 and is mounted under the inclined surface 24. The straining board 23 has multiple straining holes 231 formed therethrough.

After the mop 10 is soaked by water for cleaning the environment, the dirty cleaning unit 12 is scrubbed on the step 22 to get cleaned.

With reference to FIGS. 5 to 8, then the base 11 and the cleaning unit 12 are put on the straining board 23, and the rod 14 is pivoted downward. The user may step in the recess 21 of the bucket body 200 to keep the bucket body 200 from tipping over. When the rod 14 is pivoted downward, the limiting protrusion 143 engages one of the notches 112 and the top edge of the base 11 abuts against the inclined surface 24 of the bucket body 200 so that the base 11 and the cleaning unit 12 are clamped by the inclined surface 24 and the straining board 23 to squeeze out the water in the cleaning unit 12. When the cleaning unit 12 is squeezed for a while, the rod 14 is released and the base 11 is rotated for 180 degrees. Then the rod 14 is pivoted downward again and the limiting protrusion 143 engages the other one of the notches 112 such that the cleaning unit 12 is squeezed from the opposite side to thoroughly strain the cleaning unit 12.

Therefore, the mop 10 and the bucket 20 as described simply use the cooperation of the base 11, the straining board 23 and the inclined surface 24 to strain the cleaning unit 12 without touching the cleaning unit 12 by user's hand. The simple structures of the mop 10 and the bucket 20 as described are easily made and the manufacturing cost is thus lowered. Moreover, the mop 10 and the bucket 20 as described only bear the user's force that pivots the rod 14 downward so are not damaged easily. Thus, the lifespan of the mop 10 and the bucket 20 as described are elongated.

Figure 9:
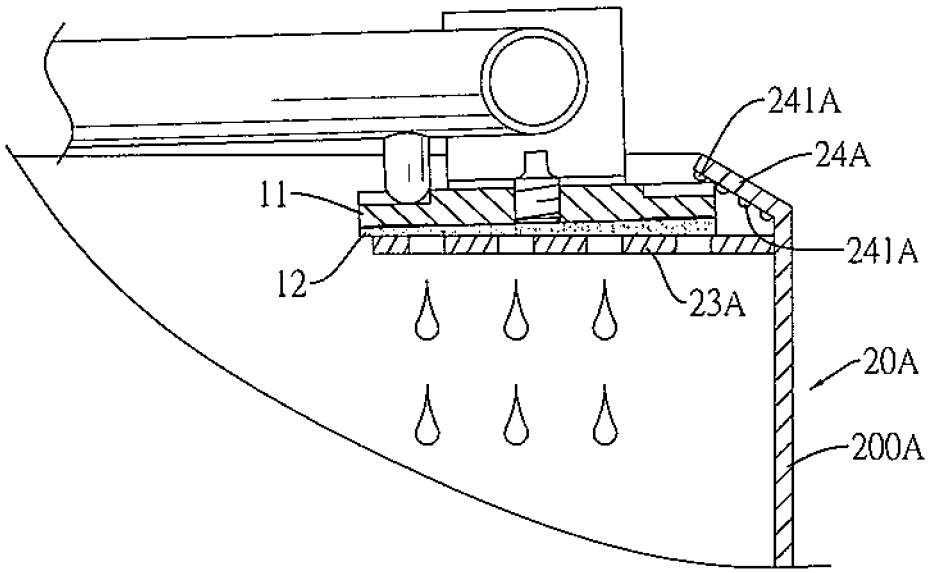
FIG. 9 is an enlarged side view in partial section of another embodiment of a bucket in accordance with the present invention.

With further reference to FIG. 9, the inclined surface 24A of the bucket 20A may have multiple ribs 241A formed on an inside wall of the inclined surface 24A, disposed between the inclined surface 24A and the straining board 23A, and arranged separately along a protruding direction of the inclined surface 24A from the tap edge of the bucket body 200A to respectively abut the cleaning units 12 with different thicknesses.

Figure 10:
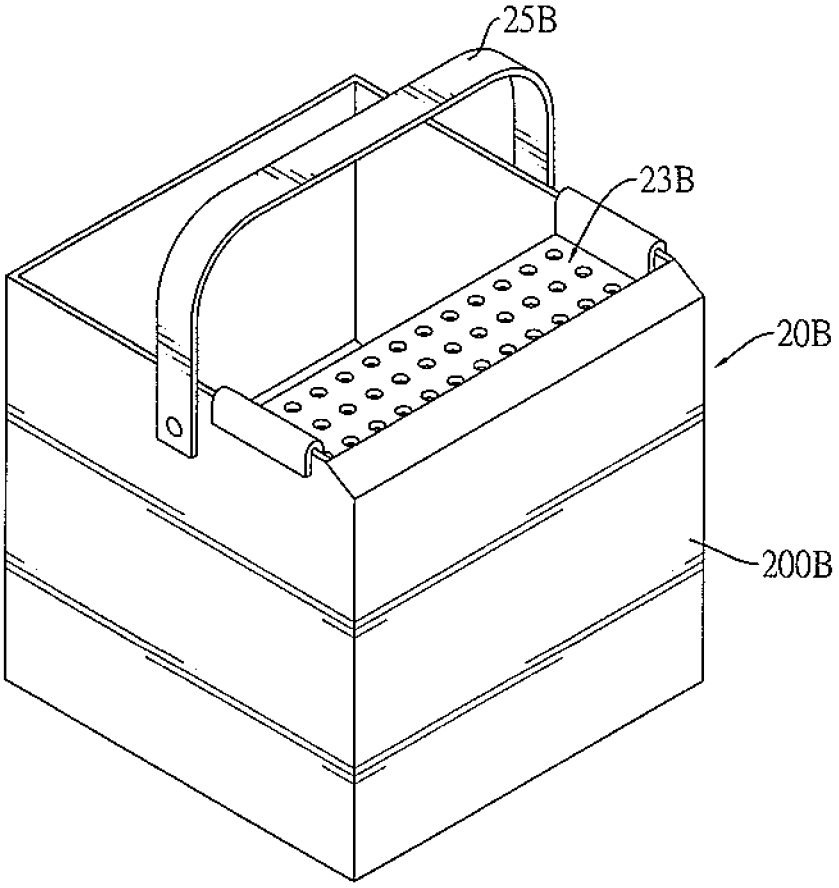
FIG. 10 is a perspective view of still another embodiment of a bucket in accordance with the present invention.

With further reference to FIG. 10, the bucket 20B may have a handle 25B mounted pivotally on the outside wall of the bucket body 200B to allow the user to easily lift the bucket 20B. The straining board 23B may be hung on the top edge of the bucket body 200B.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A bucket comprising:

a bucket body having a cavity formed in the bucket body; and an inclined surface formed on a top edge of the bucket body;

a straining board mounted on the top edge of the bucket body, mounted under the inclined surface, and having multiple straining holes formed through the straining board; and wherein the inclined surface of the bucket body has multiple ribs formed on the inclined surface, disposed between the inclined surface and the straining board, and arranged separately along a protruding direction of the inclined surface from the top edge of the bucket body.

2. The bucket as claimed in claim 1, wherein the bucket body has a recess formed on an outside wall of the bucket body near a bottom of the bucket body.

3. The bucket as claimed in claim 2 further comprising a handle mounted pivotally on the outside wall of the bucket body.

4. The bucket as claimed in claim 2, wherein the straining board is hung on the top edge of the bucket body.

5. The bucket as claimed in claim 1, wherein the bucket body has a step formed in the cavity and has multiple elongated protrusions formed on the step.

6. The bucket as claimed in claim 5 further comprising a handle mounted pivotally on an outside wall of the bucket body.

7. The bucket as claimed in claim 5, wherein the straining board is hung on the top edge of the bucket body.

8. The bucket as claimed in claim 1 further comprising a handle mounted pivotally on an outside wall of the bucket body.

9. The bucket as claimed in claim 1, wherein the straining board is hung on the top edge of the bucket body.

* * * * *